US010982465B2

(12) United States Patent
Jin

(10) Patent No.: US 10,982,465 B2
(45) Date of Patent: Apr. 20, 2021

(54) LABOR-SAVING TENT FRAME

(71) Applicant: Zuoxian Jin, Yiwu (CN)

(72) Inventor: Zuoxian Jin, Yiwu (CN)

( * ) Notice: Subject to any disclaimer, the term of this patent is extended or adjusted under 35 U.S.C. 154(b) by 0 days.

(21) Appl. No.: 16/838,039

(22) Filed: Apr. 2, 2020

(65) Prior Publication Data

US 2020/0232247 A1 Jul. 23, 2020

Related U.S. Application Data

(63) Continuation-in-part of application No. PCT/CN2018/111359, filed on Oct. 23, 2018.

(30) Foreign Application Priority Data

Sep. 19, 2018 (CN) ..... 201821538174.3

(51) Int. Cl.
*E04H 15/48* (2006.01)

(52) U.S. Cl.
CPC ..... *E04H 15/48* (2013.01)

(58) Field of Classification Search
CPC ..... E04H 15/48; E04H 15/28
See application file for complete search history.

(56) References Cited

U.S. PATENT DOCUMENTS

2006/0231129 A1* 10/2006 Ferraro, Sr. ..... E04H 15/28 135/135

FOREIGN PATENT DOCUMENTS

| | | | | |
|---|---|---|---|---|
| CN | 101111653 | A | | 1/2008 |
| CN | 201460396 | U | | 5/2010 |
| CN | 201915685 | U | | 8/2011 |
| CN | 202000737 | U | | 10/2011 |
| CN | 205370101 | U | | 7/2016 |
| CN | 205531639 | U | | 8/2016 |
| CN | 208456259 | U | | 2/2019 |
| JP | 2002521591 | A | * | 7/2002 |
| KR | 20060133162 | A | | 12/2006 |
| KR | 20090083569 | A | * | 8/2009 |

* cited by examiner

*Primary Examiner* — Noah Chandler Hawk
(74) *Attorney, Agent, or Firm* — Bayramoglu Law Offices LLC

(57) ABSTRACT

A labor-saving tent frame includes an upper hub, a lower hub and a drawstring structure, wherein the upper hub is articulated with inner ends of a plurality of long ribs, the lower hub is articulated with inner ends of a plurality of short ribs, and outer ends of the short ribs are articulated with middle portions of the long ribs in one-to-one correspondence; the tent frame further includes a long-short-rib articulated torsion spring provided with a first force arm of the torsion spring and a second force arm of the torsion spring, and the long rib and the short rib are fixed to the first force arm and the second force arm of the torsion spring respectively; the drawstring structure includes a drawstring with which the upper hub and the lower hub may be pulled closer, and two pulling ends of the drawstring hang down below the lower hub.

12 Claims, 13 Drawing Sheets

LABOR-SAVING TENT FRAME

CROSS REFERENCE TO THE RELATED APPLICATIONS

This application is a Continuation-in-part application of International Publication No. PCT/CN2018/111359, filed on Oct. 23, 2018, which is based upon and claims priority to Chinese Patent Application No. 201821538174.3, filed on Sep. 19, 2018, the entire contents of which are incorporated herein by reference.

TECHNICAL FIELD

The present utility model relates to the field of leisure tourism products, and in particular, to a foldable labor-saving tent frame.

BACKGROUND

Chinese patent document CN201915685U, published on Aug. 3, 2011, discloses a portable umbrella type tent, which mainly includes a supporting tent frame and a tent cloth arranged at an inner side of the tent frame. The tent frame includes a frame body and three or more supporting rods which are distributed radially, wherein the frame body is divided into an upper hub structure and a lower hub structure, the supporting rod is divided into a long rib, a short rib and one or more folding ribs, the long and short ribs are articulated in a T shape by a middle connector, the folding rib is movably connected to the long rib by a folding connector, a long rib connector is provided at a position of the long rib movably connected to the upper hub structure, and a short rib connector is provided at a position of the short rib movably connected to the lower hub structure. The utility model provides a firm and durable umbrella type tent which is quite rapid and convenient to unfold and fold without assembly and disassembly, and saves time for a user to unfold and fold the tent. In such a technical solution, an articulated relationship exists respectively between an upper hub and the long rib, between a lower hub and the short rib, as well as between the long and short ribs to form a triangle whose three sides are the long rib, the short rib and the virtual connecting line between the upper and lower hubs respectively. When the tent is in a folded state, the virtual connecting line between upper and lower hubs becomes longest, and an included angle between the long and short ribs approaches 180 degrees. In this state, a force arm pushing the short rib to rotate is quite short. If the user is to unfold the tent, a great force is required to form a moment of force large enough to push the short rib to rotate, so as to decrease the included angle between the long and short ribs to reduce a distance between the upper and lower hubs. In view of a large size, a heavy weight and a large friction force of the tent frame, an operation of unfolding the tent requires the user to have good physical strength, thereby limiting utilization of the tent. In order to facilitate utilization, a drawstring structure is also applied to the traditional tent frame to assist the user in reducing the distance between the upper and lower hubs. However, generally, the traditional drawstring structure is designed into a pull-up type. That is, the frame may only be unfolded by pulling the drawstring upwards from the upper hub, which is a huge inconvenience to those of low height (i.e. of short stature).

SUMMARY

Based on the above problems, the present utility model provides a labor-saving tent frame which shows improvements in two aspects. In the first aspect, the force required to push the short rib to rotate may be reduced remarkably, thereby removing the force obstacle, and in the second aspect, the direction along which the user should apply force is changed to be downward from the lower hub, thereby removing the height obstacle.

To achieve the objective described above, the following technical solution is adopted in the present utility model. A labor-saving tent frame includes an upper hub and a lower hub, the upper hub is articulated with inner ends of a plurality of long ribs, the lower hub is articulated with inner ends of a plurality of short ribs, and outer ends of the short ribs are articulated to the long ribs in one-to-one correspondence; the tent frame further includes a long-short-rib articulated torsion spring provided with a first force arm of the torsion spring and a second force arm of the torsion spring, and the long ribs and the short ribs are fixed to the first force arm and the second force arm of the torsion spring respectively.

The labor-saving tent frame in this design includes the long rib and the short rib, wherein the inner end of the long rib is articulated with the upper hub, the inner end of the short rib is articulated with the lower hub, and the outer end of the short rib is articulated with the middle portion of the long rib. The articulated structure includes the torsion spring including at least one spring, one force arm is led out from each of two ends of the spring respectively to form the first force arm of the torsion spring and the second force arm of the torsion spring, and directions of elastic forces of the two force arms are circumferential directions of cylindrical spaces formed by coils of the spring. The elastic force of the torsion spring may be applied to the articulated relationship between the long rib and the short rib by fixing the first and second force arms of the torsion spring to the long and short ribs respectively, and when unfolded, the long and short ribs receive the elastic force released by the torsion spring, thereby reducing or replacing manpower (i.e. reducing the load required to be applied by the user). When folding the tent, the elastic force is accumulated in the torsion spring. When unfolding the tent, the elastic force accumulated in the torsion spring is released to assist the long rib and the short rib in overcoming corner resistance and in forming a certain supporting angle. Therefore, a rapid and labor-saving effect is achieved when the lower hub is pushed to approach the upper hub to unfolding the tent, In the solution, the problem that unfolding an articulated position between the long and short ribs requires large manpower is solved, and the problem of the pulling direction of the drawstring is also solved, such that the tent frame has a wider scope of application, and more persons may use the tent frame smoothly without the force and height obstacles. In the solution, the articulated structures between the upper hub and the long rib, between the lower hub and the short rib, as well as between the long and short ribs may be configured as corresponding structures in patent application CN201820837645.4 filed on May 31, 2018.

Preferably, the upper hub is provided with a long-rib connecting engaged groove for connecting the long rib, the lower hub is provided with a short-rib connecting engaged groove for connecting the short rib, the upper hub is further provided with an upper engaged groove, the lower hub is further provided with a lower engaged groove, a limiting hook is provided between the upper and lower hubs, and two ends of the limiting hook are respectively located in the upper engaged groove and the lower engaged groove. The upper and lower hubs are limited axially by a limiting hook. The rear end of the limiting hook is articulated with one of the upper and lower hubs, the other hub is provided with a hook snap-fit position corresponding to the limiting hook, and usually, the hook snap-fit position has a recessed shape fitted with the front end of the hook in shape and size. When the upper and lower hubs draw close and the tent frame is unfolded fully, the front end of the limiting hook may be snap-fitted at the hook snap-fit position to avoid automatic shrinkage of the tent due to an increased distance between the upper and lower hubs caused by an external force.

Preferably, the long-short-rib articulated torsional spring includes a torsional spring body, and two ends of the torsional spring body are free ends, wherein one of the free ends forms a first force arm of the torsional spring, and the other one of the free ends forms a second force arm of the torsional spring. The first force arm of the torsional spring rotates driven by the moving of the long rib, and the second force arm of the torsional spring rotates driven by the moving of the short rib. When the torsional spring is in a natural state, an inclined angle exists between projections of the first force arm and the second force arm of the torsional spring on an axial end face of the torsional spring. When folding the tent, the long rib and the short rib move relative to one another, resulting in a positional change of the first force arm and the second force arm of the torsional spring and a deformation of the torsional spring, thus accumulating elastic force in the torsional spring. When unfolding the tent, the elastic force accumulated in the torsional spring is released. The first force arm and the second force arm of the torsional spring are arranged in a staggered manner, which facilitates the connection between the long rib and the short rib, and also promotes the elastic force accumulation when the long rib and the short rib move relative to each other.

Preferably, the first force arm of the torsional spring is L-shaped, the second force arm of the torsional spring is L-shaped or I-shaped, and the plane where the first force arm is located is perpendicular to the plane where the second force arm of the torsional spring.

Preferably, the long rib includes a long-rib rod and a long-rib-side articulated member sleeved on the long-rib rod, the first force arm of the torsional spring is connected to the long-rib-side articulated member, a limiting face is provided on the long-rib-side articulated member, and the first force arm of the torsional spring abuts against the limiting face. The limiting face is located in the moving direction of the first force arm of the torsional spring, such that the first force arm of the torsional spring is rotated when the long rib moves. The limiting face is maintained in the reset direction of the first force arm of the torsional spring. When folding, the long rib moves, the limiting face pushes the first force arm of the torsional spring to move toward the pulling direction of the torsional spring, thereby accumulating elastic force in the torsional spring. When unfolding, the elastic force accumulated in the torsional spring is released, the first force arm of the torsional spring moves toward the reset direction of the torsional spring to push the limiting face to move, thereby unfolding the long rib.

Preferably, the short rib includes a short-rib rod and a short-rib-side articulated member sleeved on the short-rib rod, a b-shaped through hole is provided on the short-rib-side articulated member, the long-short-rib articulated torsional spring is mounted in the b-shaped through hole of the short-rib-side articulated member, and the second force arm of the torsional spring abuts against the vertical channel of the b-shaped through hole. The torsional spring body is located in the circular channel of the b-shaped through hole, and the second force arm of the torsional spring is located in the vertical channel, such that the torsional spring is well mounted in the short rib, and the second force arm of the torsional spring is rotated when stressed instead of slipping off from the vertical channel. Since the short rib moves relative to the long rib by an angle of 180 degrees, the second force arm of the torsional spring has to be formed with two limiting faces to allow a swing in two directions. The second force arm of the torsional spring is located in the vertical channel, such that the second force arm of the torsion spring, in any moving direction, can achieve the elastic force accumulation and release of the torsional spring.

Preferably, the long rib and the short rib are articulated by the long-rib-side articulated member and the short-rib-side articulated member to form a long-short-rib articulated pair, and the long-rib-side articulated member and the short-rib-side articulated member are fixed by a long-short-rib articulated axis pin.

Preferably, the long-rib-side articulated member is provided with a long-rib through hole and a pair of articulated shaft seats, each articulated shaft seat is provided with an articulated shaft hole, and the axis direction of the articulated shaft hole is perpendicular to the axis direction of the long-rib through hole. Concave escape grooves are provided at opposite surfaces of the two articulated shaft seats, and each escape concave groove has one end starting from a root of the articulated shaft seat and the other end terminating at least at the articulated shaft hole. When the torsion spring and the short-rib-side articulated member are mounted together, the first force arm of the torsion spring protrudes beyond the mounting surface for the second force arm of the torsion spring. If such a short-rib-side articulated member is mounted to the long-rib-side articulated member directly, the first force arm of the torsion spring may interfere in the articulated shaft seat at the long-rib-side articulated member to cause great friction, which is unfavorable to the mounting process and utilization. In view of this issue, the escape groove is designed in the present solution and may accommodate the first force arm of the torsion spring protruding outside, thereby eliminating such interference to facilitate the mounting process and the utilization.

Preferably, a drawstring structure is provided between the upper and lower hubs.

There are two solutions for the drawstring structure, one is for further saving of labor, and the other is for simplifying structure.

As one preferred solution, the drawstring structure includes a pair of upper string shafts provided at the upper hub horizontally and a lower string shaft provided at the lower hub horizontally; the middle portion of the drawstring is fixed to the lower string shaft relatively, body parts of the drawstring located at two sides of the lower string shaft are wound around the upper string shafts respectively, and the two pulling ends of the drawstring hang down below the lower hub respectively. In such a design, since the upper and lower hubs may be moved towards each other relatively independently, the upper string shafts function as movable pulleys, the lower string shaft functions as another movable pulley, and the drawstring is wound in a pulley set composed of the three movable pulleys to form a labor-saving structure. When the user pulls the drawstring, a pulling distance becomes longer, and a pulling force is reduced, thereby achieving a labor-saving effect.

Preferably, the upper hub is coaxial with the lower hub and provided with an upper sleeve, the lower hub is provided with a lower sleeve, and the upper and lower sleeves are both coaxial with the upper hub and may be fitted with each other. In the solution, one sleeve is designed at each of the upper and lower hubs respectively and the two sleeves include a sleeving connection, such that when the tent frame is unfolded, the upper and lower hubs approach to each other and may limit each other.

Preferably, at least one of the upper and lower sleeves is provided with a structure for forming an axial limiting between the upper and lower sleeves. Usually, such a limiting structure may be a convex strip, or the like, provided at opposite sleeved surfaces of the sleeves. The arrangement of such a limiting structure may restrict positions of the upper and lower hubs when they approach to one another, and avoid destroying the articulated structure due to the upper and lower hubs are too close to each other.

Preferably, the drawstring has an annular pulling end which is easily held by a user.

Preferably, a rigid pull ring is provided around the annular pulling end of the drawstring, and may be more comfortable for a user when pulling the drawstring.

As the second preferred solution, the drawstring structure includes an upper-hub drawstring hole vertically passing through a lower end surface of the upper hub; a limiting mechanism is provided at the drawstring and has a diameter greater than the upper-hub drawstring hole; a section of the drawstring provided with the limiting mechanism is located above the upper-hub drawstring hole, and the two pulling ends of the drawstring pass through the upper-hub drawstring hole and the lower hub downwards. In the solution, the upper-hub drawstring hole is located at the upper hub and vertically passes through the lower end surface of the upper hub. After the drawstring is folded in half, the middle portion is located above the upper-hub drawstring hole, and the limiting mechanism is fixedly connected above the upper-hub drawstring hole and has the diameter greater than the upper-hub drawstring hole. Specifically, the limiting mechanism may be configured as an object tied to the drawstring, such as an axis pin, or configured as a knot large enough or the like directly tied in the middle portion of the drawstring. Two ends of the drawstring pass through the upper-hub drawstring hole and the lower hub downward. Since the both ends of the drawstring are located below the lower hub, the user may pull the drawstring below the lower hub, and the upper hub may be driven to move towards the lower hub by the limiting mechanism, thereby driving the long and short ribs to be unfolded to support the tent frame. The drawstring structure herein is different from that described above in that, the structure is simplified, the assembly is faster and convenient, and the drawstring has a shorter pulling distance.

Preferably, a pair of lower-hub drawstring holes vertically run through the lower hub, and have axial directions which do not coincide with the axial direction of the upper-hub drawstring hole; the two ends of the drawstring pass through the lower-hub drawstring hole downwards. In the solution, the pair of lower-hub drawstring holes are designed at the lower hub and have the axial directions which do not coincide with the upper-hub drawstring hole, such that when the two ends of the drawstring are pulled with a large force at the same time, not only the upper hub will move towards the lower hub, but the lower hub will move towards the upper hub synchronously, which improves the efficiency of pulling the drawstring.

Preferably, the limiting mechanism is configured as a limiting bead provided with a radial through hole, and the drawstring passes through the limiting bead via the through hole. The limiting bead has a low manufacturing cost, enables the drawstring to pass through rapidly and facilitates assembly. Moreover, the limiting bead has a big advantage that when the drawstring is tightened, an effective limit is created between the spherical surface of the limiting bead and the upper-hub drawstring hole, such that the limiting bead may not roll randomly, which facilitates utilization. In practical applications, a shape of the limiting bead is not limited to a regular spherical shape, but may also be a near-spherical shape, such as an olive (or oval) shape, or a partially spherical shape, such as a drum shape with two small ends and a large middle. If the near-spherical shape or partially spherical shape is used, it should be ensured that when the drawstring is tightened, an arc surface should directly face an upper opening of the upper-hub drawstring hole, so as to achieve an optimal limit effect.

Preferably, the upper-hub drawstring hole is provided at the bottom surface of the upper sleeve, and the lower-hub drawstring hole is provided at the top surface of the lower sleeve; when the upper and lower hubs are fitted and sleeved, a gap is provided between the bottom surface of the upper sleeve and the top surface of the lower sleeve, and the gap has a height greater than the diameter of the drawstring. The upper-hub drawstring hole is provided at the bottom surface of the upper sleeve, the lower-hub drawstring hole is provided at the top surface of the lower sleeve, and when the upper and lower hubs designed in the solution are fitted and sleeved, the gap is reserved between the bottom surface of the upper sleeve and the top surface of the lower sleeve. After the drawstring passes through the upper-hub drawstring hole, a part of the drawstring will be located in the gap between the bottom surface of the upper sleeve and the top surface of the lower sleeve, which may avoid a situation where the drawstring located in the gap may not be pulled due to a greatly increased friction force caused by a too small of a gap between the bottom surface of the upper sleeve and the top surface of the lower sleeve.

In designing and manufacturing processes, the above two types of drawstring structures may be combined in the same set of the upper and lower hubs in a factory, and one of the drawstring structures is selected for assembly according to needs of an order, so as to reduce a number of molds and lower the manufacturing cost.

In summary, the present utility model has the following advantages. The force required to push the short rib to rotate may be reduced remarkably, thereby removing the force obstacle; the direction in which the user should apply force is changed to be downward from the lower hub, thereby removing the height obstacle.

Figure 1:
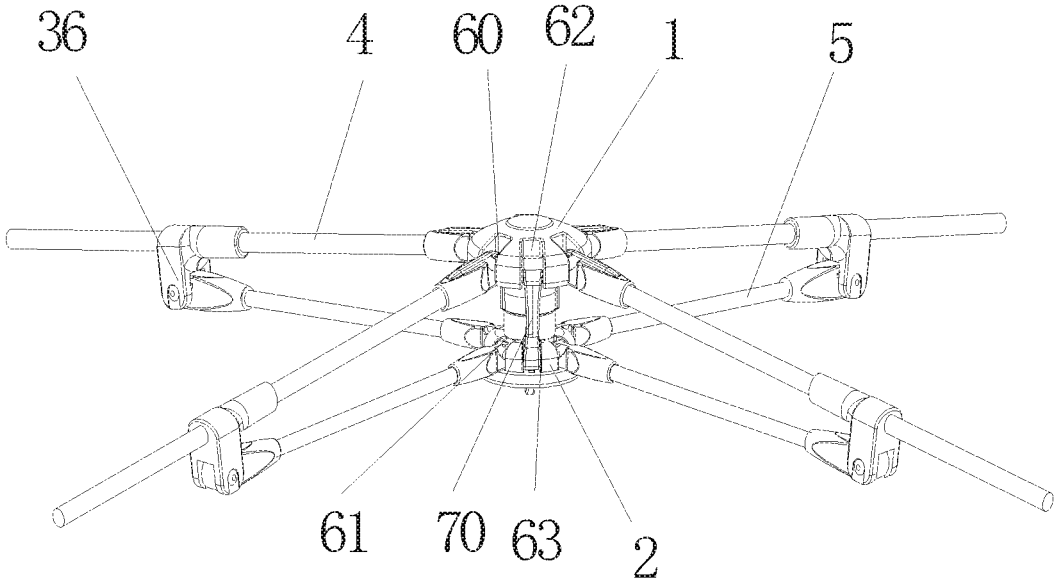
FIG. 1 is a schematic diagram of the tent in an unfolded state according to embodiment 1 of the present invention.

In the drawings, features are identified as follows: 1 upper hub; 2 lower hub; 3 drawstring; 4 long-rib rod; 5 short-rib rod; 6 upper string shaft; 7 lower string shaft; 8 drawstring through hole; 9 upper sleeve; 10 lower sleeve; 11 pull ring; 31 long-short-rib articulated torsion spring; 34 long-rib-side articulated member; 35 short-rib-side articulated member; 36 long-short-rib articulated pair; 37 long-rib through hole; 38 articulated shaft seat; 39 articulated shaft hole; 40 *b*-shaped through hole; 41 vertical channel of the b-shaped through hole; 42 long-short-rib articulated axis pin; 44 limiting face for first force arm of torsional spring; 47 escape groove; 51 upper-hub drawstring hole; 52 lower-hub drawstring hole; 53 limiting bead; 60 long-rib connecting engaged groove; 61 short-rib connecting engaged groove; 62 upper engaged groove; 63 lower engaged groove; 70 limiting hook; 96 torsional spring body; 97 first force arm connecting rod; 98 second force arm of the torsion spring; 99 first force arm of the torsion spring.

DETAILED DESCRIPTION OF THE EMBODIMENTS

The present utility model will be further described below with reference to the drawings and specific embodiments.

Embodiment 1

Figure 2:
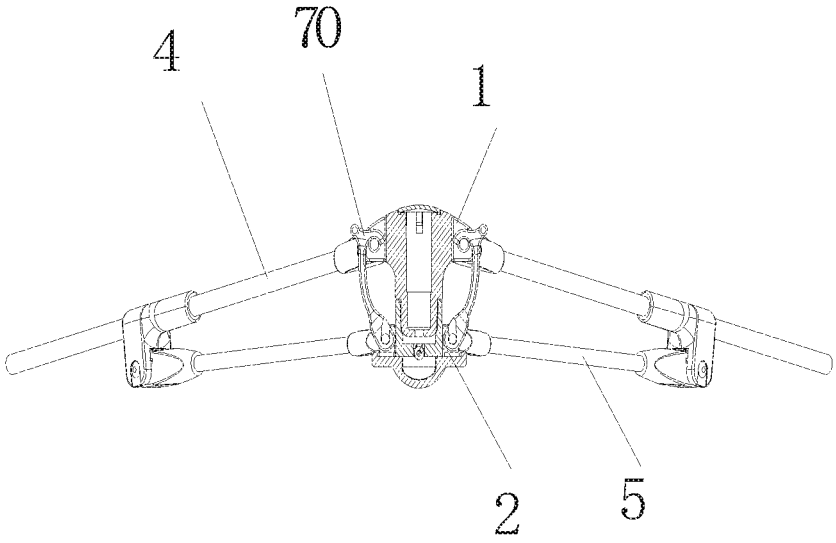
FIG. 2 is a sectional view of FIG. 1.
Figure 12:
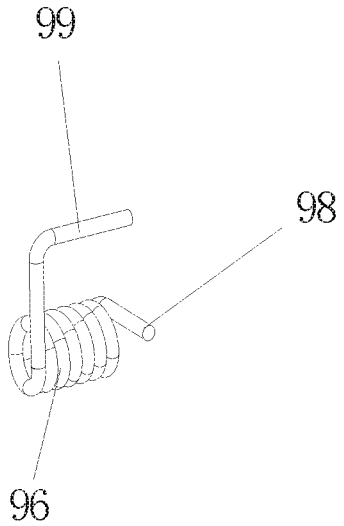
FIG. 12 is a perspective view of the torsional spring in embodiment 2.

As shown in FIG. 1 and FIG. 2, a labor-saving tent frame includes the upper hub 1 and the lower hub 2. Four long-rib connecting engaged grooves 60 are provided on the outer circumferential surface of the upper hub 1, and four long-rib rods 4 are connected inside the long-rib connecting engaged grooves 60. Further, the upper engaged groove 62 is provided on the outer circumferential surface of the upper hub 1. Correspondingly, four short-rib connecting engaged grooves 61 are provided on the outer circumferential surface of the lower hub, and the short-rib rod 5 is connected inside the short-rib connecting engaged groove. Meanwhile, the lower engaged groove 63 is provided on the outer circumferential surface of the lower hub. The upper engaged groove 62 corresponds to the lower engaged groove 63. A first end of the limiting hook 70 is mounted inside the upper engaged groove 62, and a second end of the limiting hook 70 is mounted inside the lower engaged groove. When the tent is unfolded, the two ends of the limiting hook 70 are respectively located in the upper engaged groove 62 and the lower engaged groove 63. As shown in FIG. 12, when the tent is folded, the upper end of the limiting hook 70 slips off from the upper engaged groove 62, and the lower end of the limiting hook 70 is connected inside the lower engaged groove.

Figure 3:
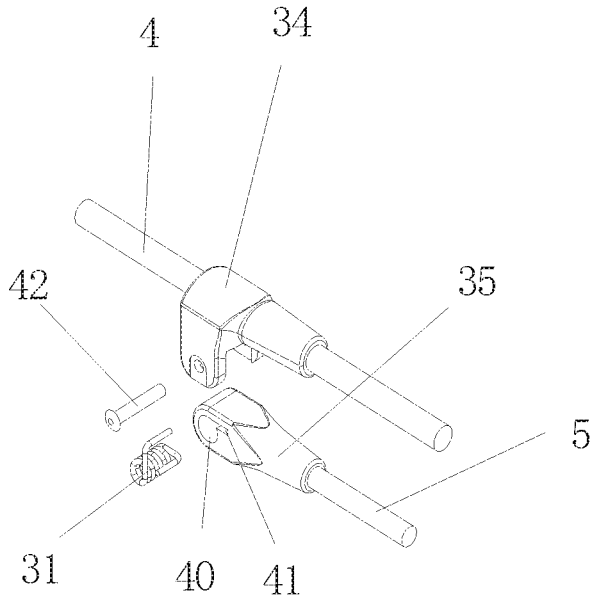
FIG. 3 is an exploded view showing the connection between the long rib and the short rib in FIG. 1.
Figure 4:
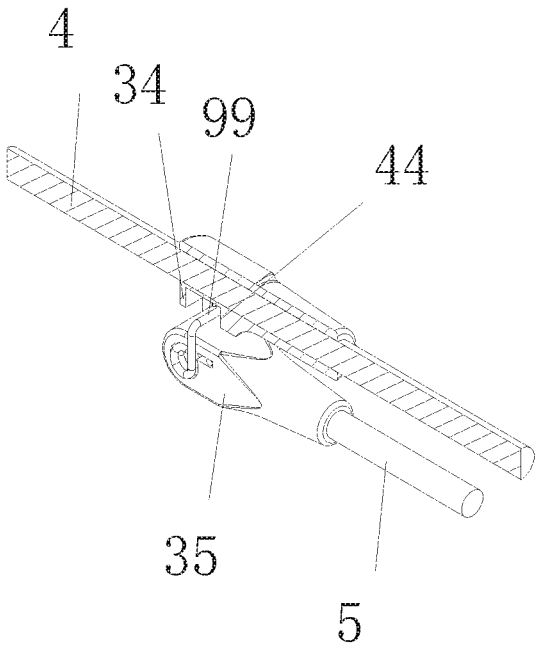
FIG. 4 is a sectional view of FIG. 3.
Figure 5:
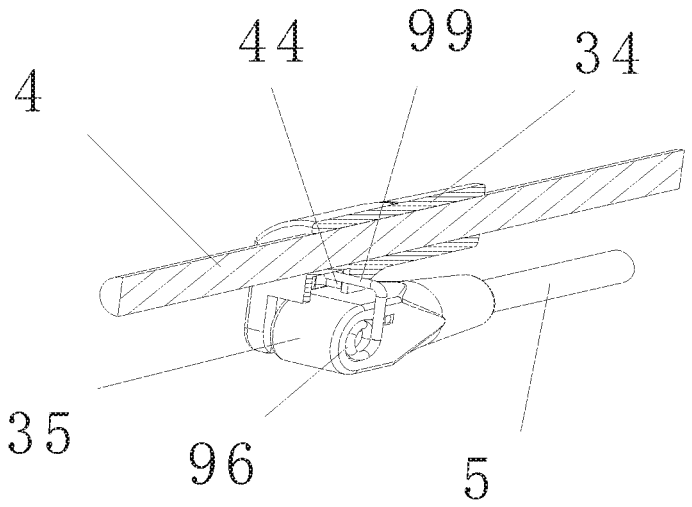
FIG. 5 is a sectional view of FIG. 3 from another perspective.

As shown in FIG. 3-FIG. 5, the long-rib rod 4 is inserted into the long-rib-side articulated member 34, and the short-rib rod 5 is inserted into the short-rib-side articulated member 35. The long-rib-side articulated member 34 and the short-rib-side articulated member 35 form the long-short-rib articulated pair 36 through the long-short-rib articulated axis pin 42. The long-short-rib articulated torsion spring 31 is provided at the articulated point of the long-rib-side articulated member 34 and the short-rib-side articulated member. The b-shaped through hole 40 is provided on the short-rib-side articulated member 35, and the b-shaped through hole includes a cylindrical through hole and the vertical channel 41 located above.

Figure 6:
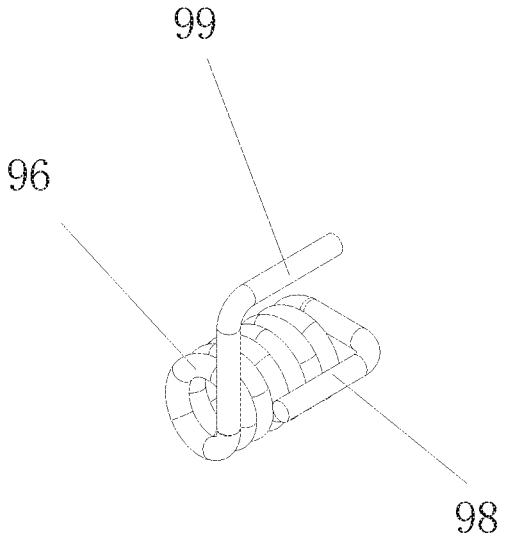
FIG. 6 is a perspective view of the torsional spring in FIG. 3.

As shown in FIG. 6, the long-short-rib articulated torsion spring 31 includes the torsional spring body 96, the torsional spring body 96 is a cylindrical vertical spring, and torsional spring body is located inside the cylindrical through hole of the b-shaped through hole. Two ends of the torsional spring body 96 protrude to form two free ends both having an "L" shape. One of the free end forms the first force arm 99 of the torsional spring, and the first force arm 99 of the torsional spring is connected to the limiting face 44 for the first force arm 99 of the torsional spring on the long-rib-side articulated member 34. The other one of the free end forms the second force arm 98 of the torsional spring, and the second force arm 98 of the torsional spring is inserted in the vertical channel 41 of the b-shaped through hole on the short-rib-side articulated member 35.

The plane where the first force arm 99 of the torsional spring is located is perpendicular to the plane where the second force arm 98 of the torsional spring is located.

Figure 7:
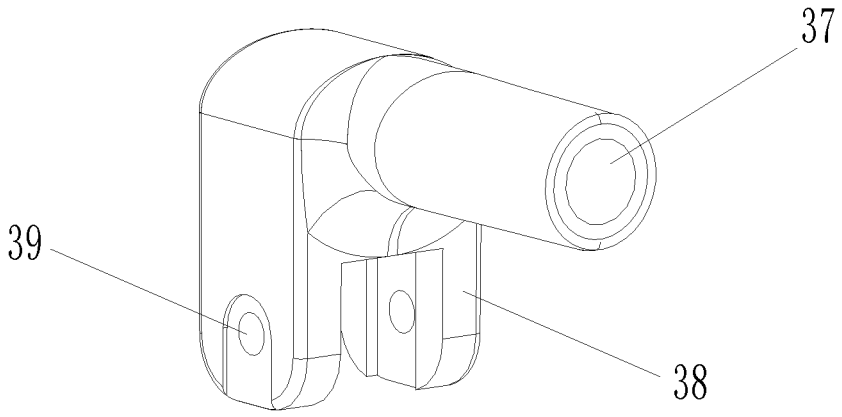
FIG. 7 is a structural schematic diagram of the long-rib-side articulated member.
Figure 8:
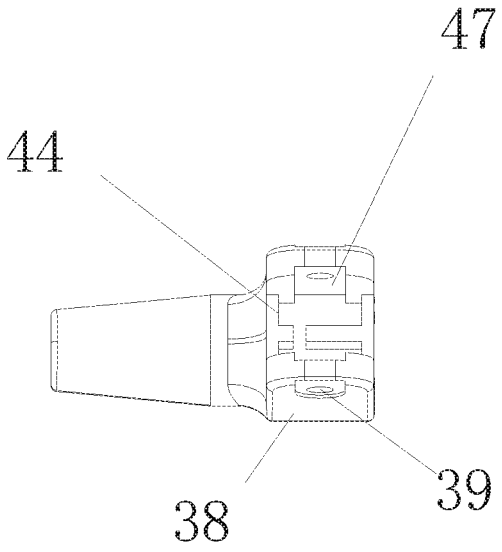
FIG. 8 is a structural schematic diagram of the long-rib-side articulated member from another perspective.

As shown in FIG. 7, the long-rib-side articulated member has an L shape, the long-rib through hole 37 is provided at a first side of the L shape, and the middle portion of the long rib may be fixedly inserted in the long-rib through hole in an interference fit; the pair of articulated shaft seats 38 are provided at a second side of the L shape and each articulated shaft seat is provided with the articulated shaft hole 39 for the long-short-rib articulated axis pin to adaptively pass through. An axial direction of the articulated shaft hole is perpendicular to that of the long-rib through hole. As shown in FIG. 8, the escape grooves 47 are concavely provided at opposite surfaces of the two articulated shaft seats, and each escape groove has one end starting from a root of the articulated shaft seat and another end extending to an upper end of the articulated shaft seat and passing halfway through an inner end of the articulated shaft hole halfway.

Figure 9:
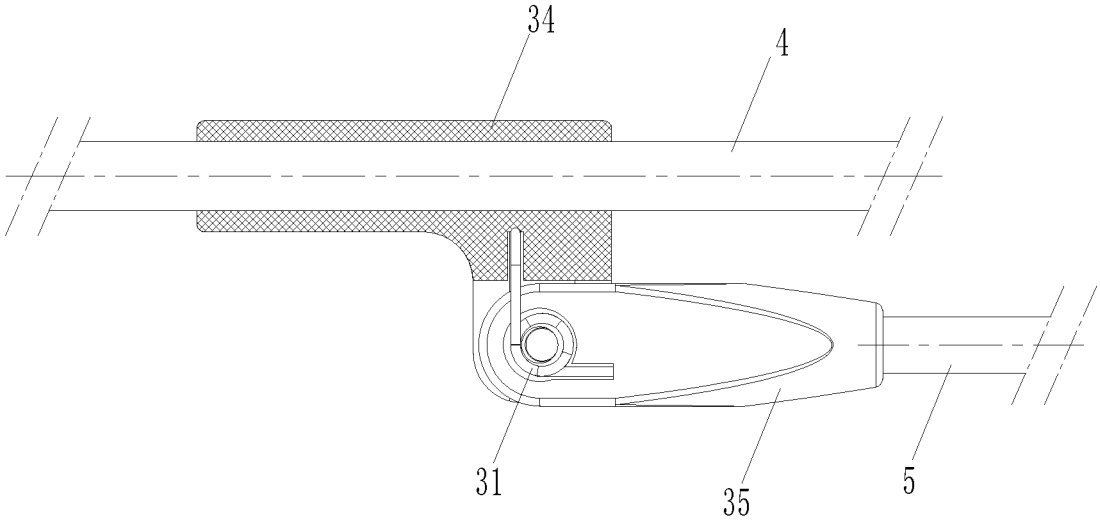
FIG. 9 is a partial sectional view of the tent along the axis direction of the long rib when the tent is folded.

As shown in FIG. 9, when the tent is folded, the short rib 5 is pushed to drive the short-rib-side articulated member 35 to rotate to initiate the rotation of the second force arm 98 of the torsional spring, the first force arm 99 of the torsional spring abuts against the limiting face 44, the two free ends of the torsional spring body oppositely rotate to form a torsion, thereby accomplishing the elastic force accumulation in the torsional spring.

Figure 10:
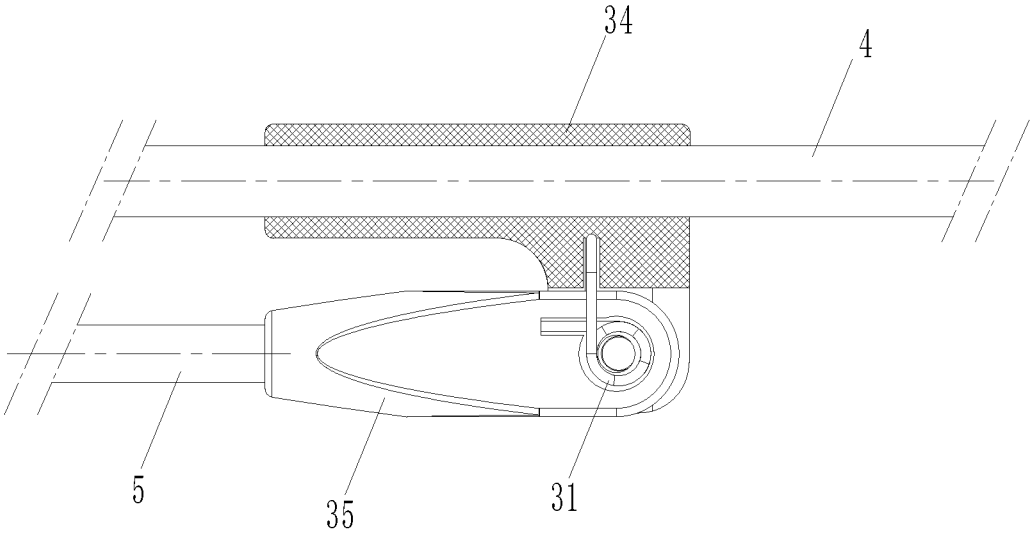
FIG. 10 is a partial sectional view of the tent along the axis direction of the long rib when the tent is unfolded.
Figure 11:
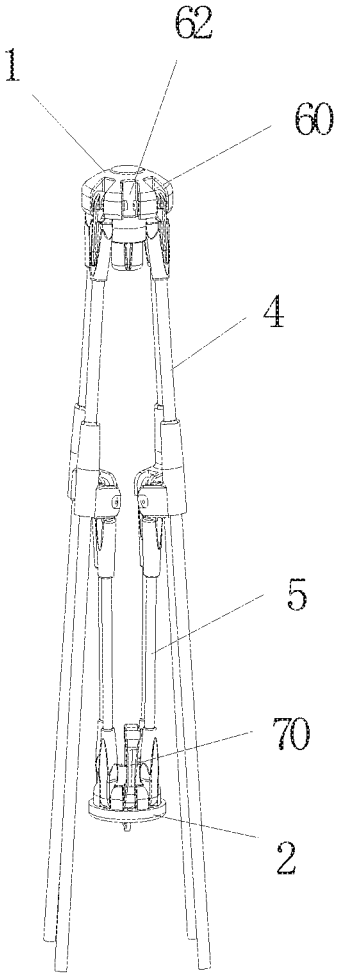
FIG. 11 is a schematic diagram of the embodiment 1 in a folded state.

As shown in FIG. 10, when the tent is required to be unfolded, since the torsion is accumulated by the staggered first force arm 99 and second force arm 98 of the torsional spring 31, the first force arm 99 and the second force arm 98 of the torsional spring need to reset via the torsion after the long-rib rod and the short-rib rod are released, so that the long-rib rod and the short-rib rod rotate relative to each other and reset to the position shown in FIG. 10 to realize the pre-unfolding of the long-rib rod and the short-rib rod, which avoids the dead angle and reduces manpower of a user to unfold the tent.

Embodiment 2

As shown in FIG. 12, the only difference of embodiment 2 from embodiment 1 is that the second force arm 98 of the torsional spring is I-shaped.

Embodiment 3

Figure 13:
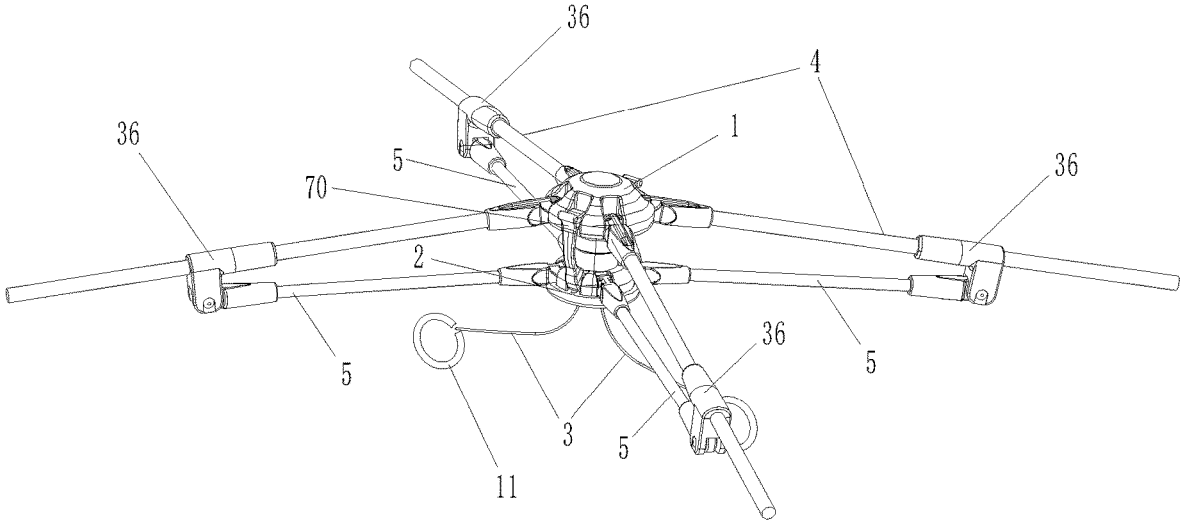
FIG. 13 is a schematic diagram of embodiment 3 of the present utility model in an unfolded state.
Figure 14:
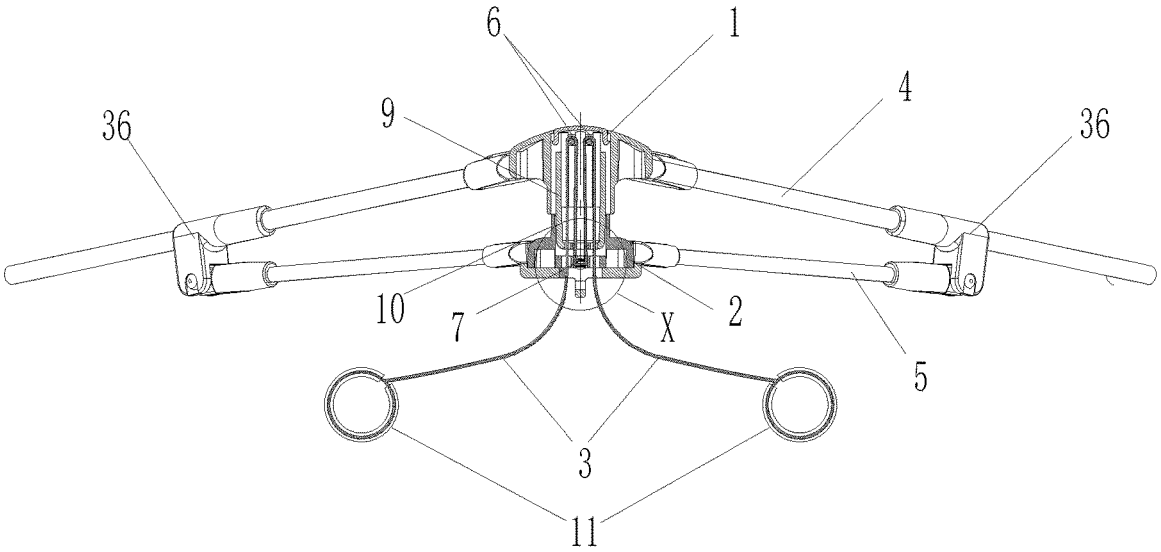
FIG. 14 is an axial sectional view of the embodiment 3.
Figure 15:
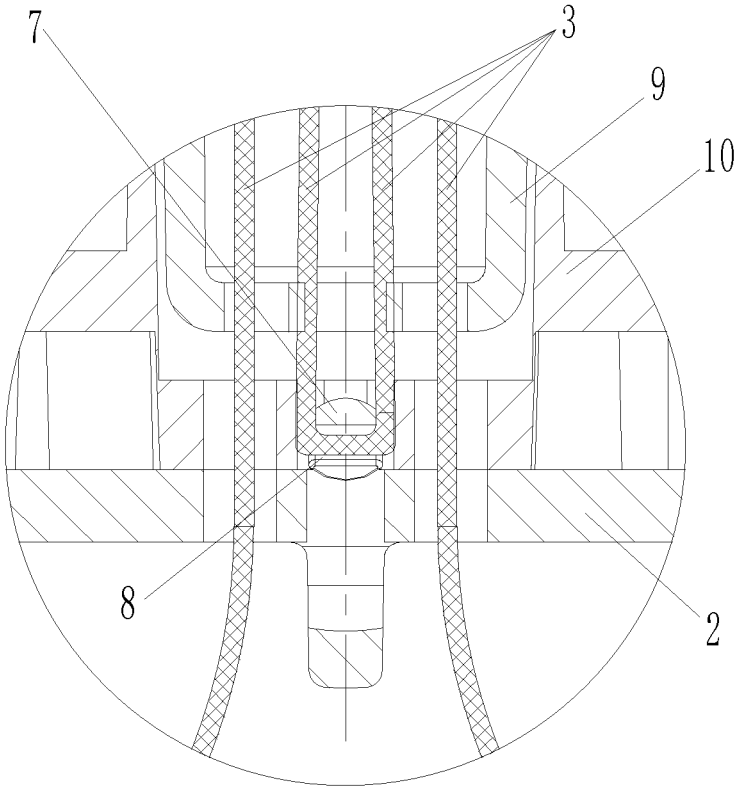
FIG. 15 is an enlarged view of portion X of FIG. 14.

As shown in FIG. 13-FIG. 15, the drawstring structure in the present embodiment is configured as a labor-saving drawstring structure. The two upper string shafts 6 which are horizontally symmetrical are provided at the upper hub horizontally, and in the embodiment, the upper string shafts are cylindrical. As shown in FIG. 3, the lower string shaft 7 is provided at the lower hub horizontally, the drawstring through hole 8 horizontally runs through the lower string shaft in a radial direction, and the middle portion of the drawstring is located in the drawstring through hole. The middle of the drawstring 3 penetrates through the drawstring through hole, two sides extend upwards respectively and are each wound around the upper string shaft to hang down, and a pulling end at the lower end is located below the lower hub. The drawstring has the annular pulling end, and the rigid pull ring 11 is provided around the annular shape. The upper hub is coaxial with the lower hub and provided with the upper sleeve 9, the lower hub is provided with the lower sleeve 10, and the upper and lower sleeves are both coaxial with the upper hub and may be adaptively sleeved with each other. The upper sleeve is configured as a stepped tube with a small lower section and a large upper section. When the upper hub approaches the lower hub, the lower section of the upper sleeve may be adaptively inserted in the lower sleeve, and the upper section of the upper sleeve has an axial limitation effect on the top surface of the lower sleeve.

Figure 16:
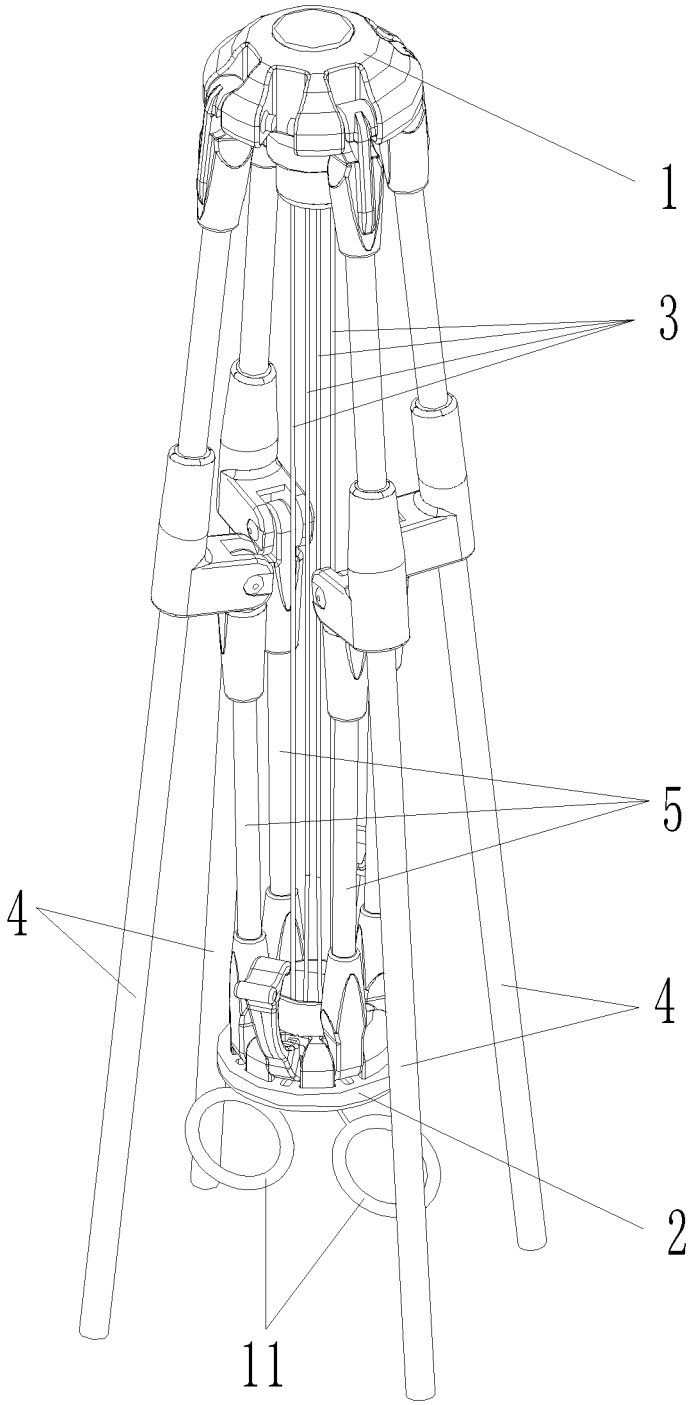
FIG. 16 is a schematic diagram of the embodiment 3 in a folded state.
Figure 17:
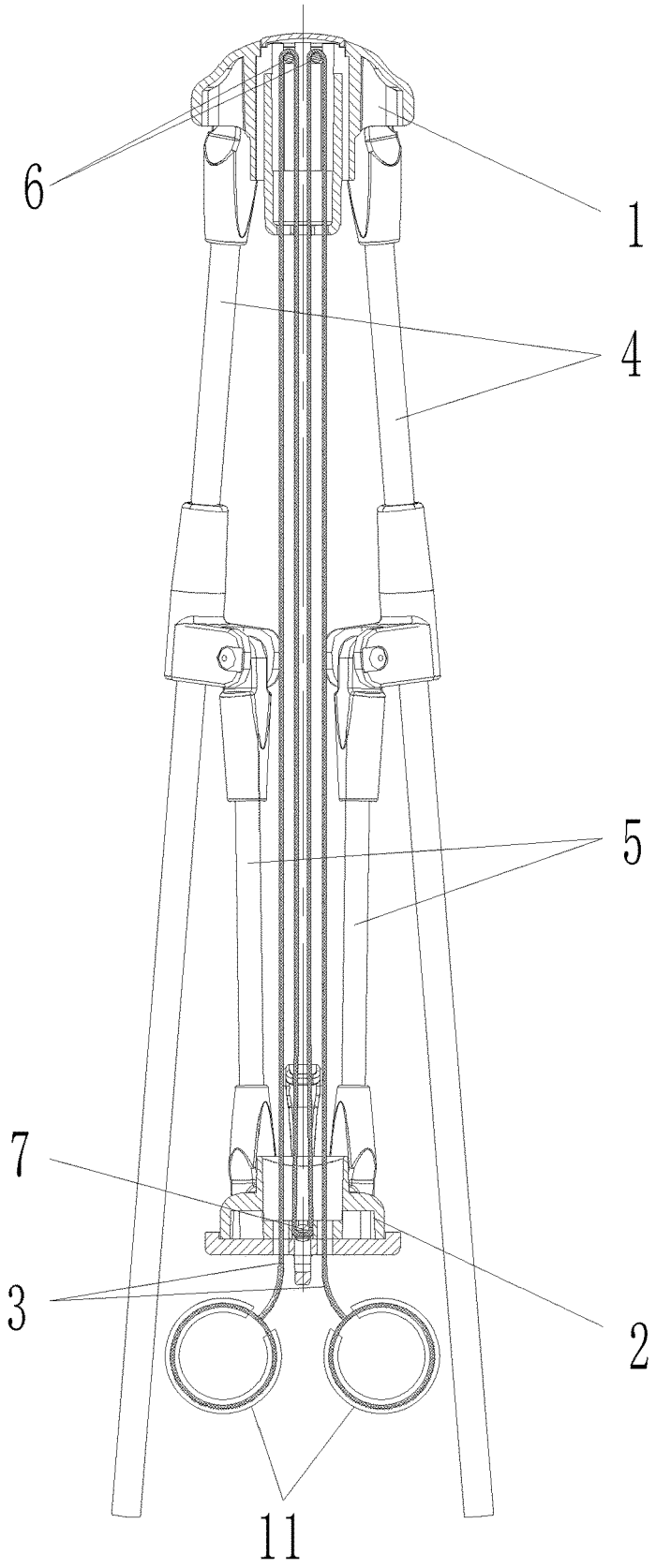
FIG. 17 is an axial sectional view of FIG. 17.

FIGS. 16 and 17 show the labor-saving drawstring structure of a tent of the present embodiment in a folded state. FIG. 9 shows states of the long and short ribs at this point. When required to unfold the tent frame, a user only needs to loosen necessary fixing pieces, a pushing force will be produced by the torsion spring between the long and short ribs to push the short rib to rotate, and at the same time, the upper hub approaches the lower hub. When the short rib and the long rib are unfolded by a relatively large angle, the user may pull the two pulling ends of the drawstring with both hands to further reduce the distance between upper and lower hubs until the upper and lower sleeves are sleeved in place adaptively. At this point, the articulated structure of the long and short ribs is also unfolded in place, the whole tent frame is unfolded, and at this point, the axial distance between upper and lower hubs is fixed by two limiting hooks to form the unfolded state as shown in FIGS. 13 and 14. FIG. 10 shows states of the long and short ribs at this point. When the tent is required to be folded after utilization, the limiting hook is released, and the long rib of the tent is folded from the outside downwards until the folded state is reached. The torsion spring in the articulated structure of the short rib and the long rib is compressed by a force to accumulate the elastic force which is released to push the short rib to rotate in a next unfolding process.

Embodiment 4

The embodiment as shown in FIG. 1 provides another labor-saving tent frame.

Figure 18:
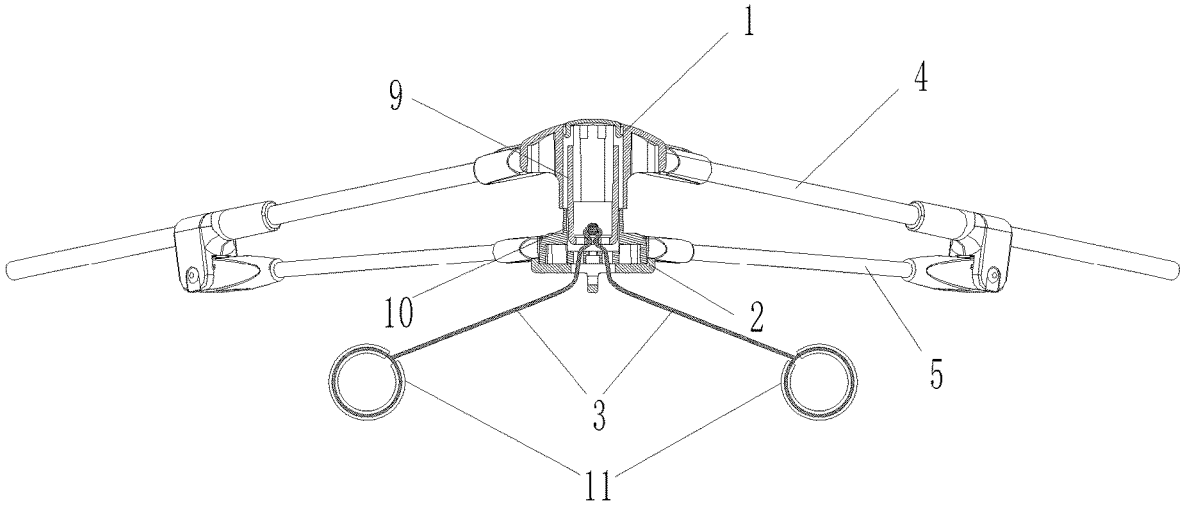
FIG. 18 is an axial sectional view of the embodiment 4.
Figure 19:
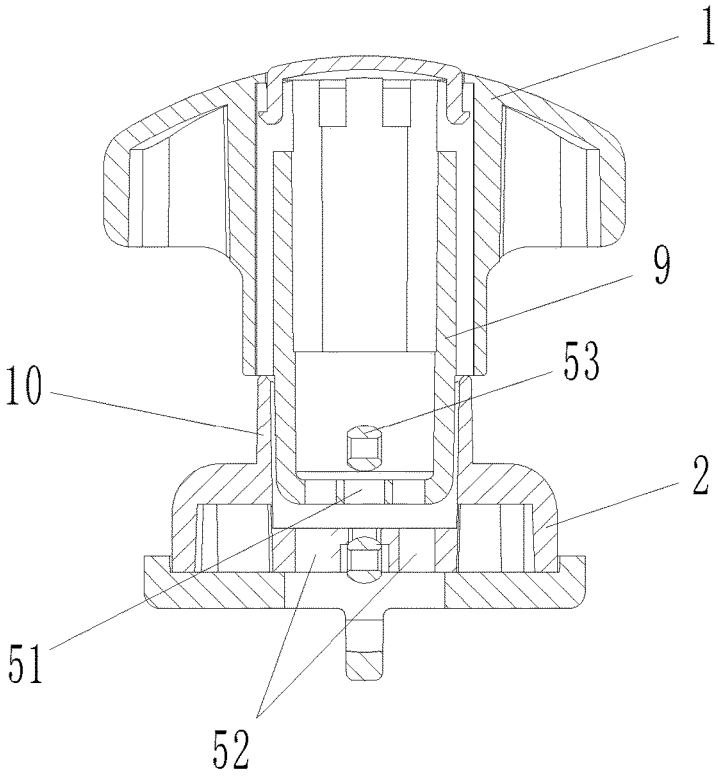
FIG. 19 is an axial sectional view of FIG. 18 when the upper hub is fitted with the lower hub.

The drawstring structure in the present embodiment is configured as a simple drawstring structure. As shown in FIGS. 18 and 19, the upper hub is provided with the upper sleeve 9, the lower hub is provided with the lower sleeve 10, and the upper and lower sleeves are both coaxial with the upper hub and may be adaptively sleeved with each other. The upper sleeve is configured as a stepped tube with a small lower section and a large upper section. When the upper hub approaches the lower hub, the lower section of the upper sleeve may be inserted in the lower sleeve adaptively, and the upper section of the upper sleeve has an axial limitation effect on the top surface of the lower sleeve. The upper-hub drawstring hole 51 is centered at the bottom surface of the upper sleeve, the pair of lower-hub drawstring holes 52 are provided at the top surface of the lower sleeve, the lower-hub drawstring holes have axial directions which do not coincide with the upper-hub drawstring hole, and are symmetrically distributed at a circle positioned at the central point of the lower hub as the center of the circle. The middle portion of the drawstring 3 is fixedly connected with a limiting mechanism. The limiting mechanism in the embodiment is configured as the spherical limiting bead 53 provided with a radial through hole, and the drawstring passes through the limiting bead via the through hole. The limiting bead is located above the upper-hub drawstring hole and has a diameter greater than the upper-hub drawstring hole. After the drawstring passes through the limiting bead, two ends are put together to pass through the upper-hub drawstring hole downwards, and then each end passes through the lower-hub draw string hole respectively, and the pulling end at the lower end is located below the lower hub. The drawstring has the annular pulling end, and the rigid pull ring 11 is provided around the annular shape. When the upper and lower hubs are sleeved adaptively, a gap is reserved between the bottom surface of the upper sleeve and the top surface of the lower sleeve, and the gap has a height greater than the diameter of the drawstring, so as to eliminate a friction force generated when the drawstring is pulled laterally in the gap.

The remaining is the same as that in embodiment 1.

Figure 20:
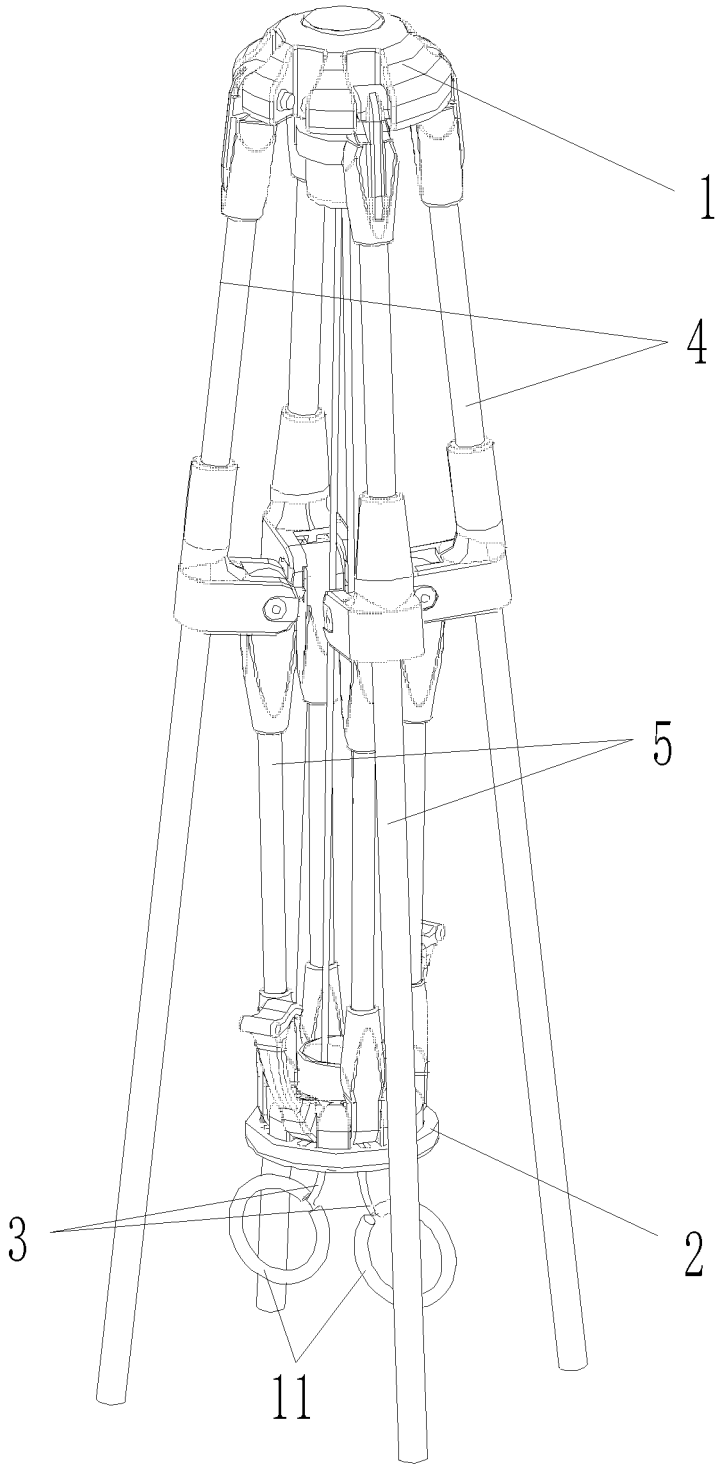
FIG. 20 is a schematic diagram of the embodiment 4 in the folded state.
Figure 21:
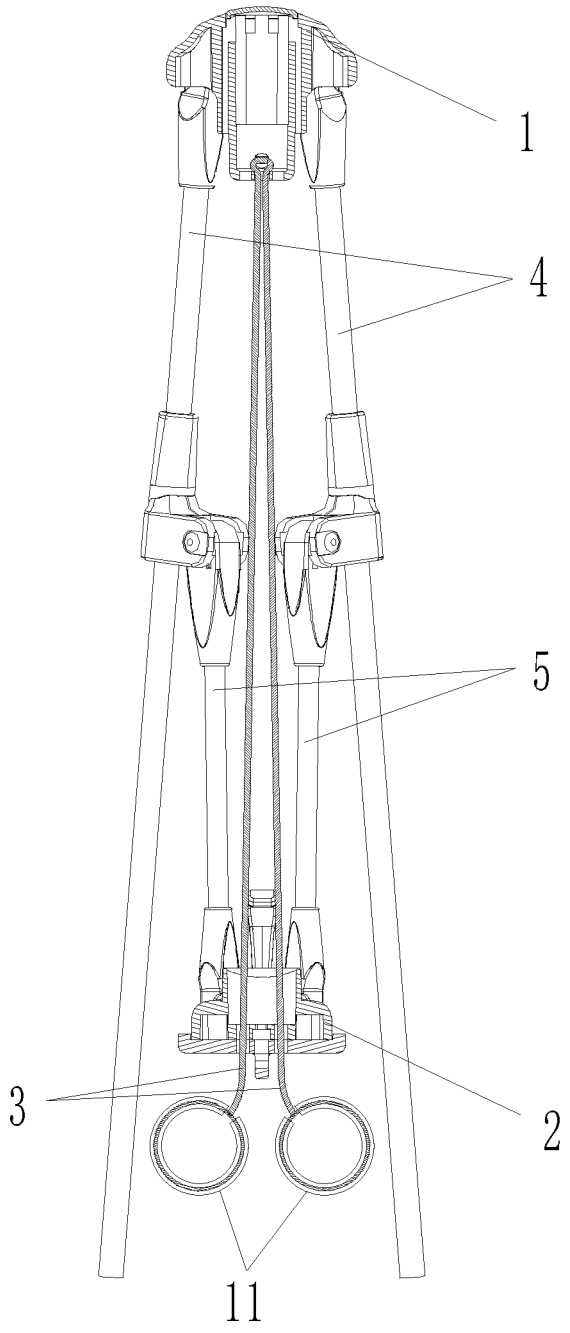
FIG. 21 is an axial sectional view of FIG. 20.

FIGS. 20 and 21 show the labor-saving drawstring structure of a tent of the present embodiment in a folded state. Unfolding and folding actions of the drawstring structure are the same as that in embodiment 3, except that in the drawstring structure of embodiment 4, the shortened pulling distance of the drawstring structure is obtained instead of saving labor.

What is claimed is:

1. A labor-saving tent frame, comprising an upper hub and a lower hub, wherein the upper hub is articulated with inner ends of a plurality of long ribs, the lower hub is articulated with inner ends of a plurality of short ribs, and outer ends of the plurality of short ribs are articulated to the plurality of long ribs in one-to-one correspondence; the tent frame further comprises a long-short-rib articulated torsion spring, the long-short-rib articulated torsion spring is provided with a first force arm of the long-short-rib articulated torsion spring and a second force arm of the long-short-rib articulated torsion spring, and the plurality of long ribs and the plurality of short ribs are fixed to the first force arm of the long-short-rib articulated torsion spring and the second force arm of the long-short-rib articulated torsion spring respectively;

wherein each of the plurality of short ribs includes a short-rib rod and a short-rib-side articulated member sleeved on the short-rib rod, a b-shaped through hole is provided on the short-rib-side articulated member, the long-short-rib articulated torsional spring is mounted in the b-shaped through hole of the short-rib-side articulated member, and the second force arm of the long-short-rib articulated torsional spring abuts against a vertical channel of the b-shaped through hole.

2. The labor-saving tent frame according to claim 1, wherein the long-short-rib articulated torsional spring comprises a torsional spring body, and two ends of the long-short-rib articulated torsional spring body are free ends; a first free end of the free ends forms the first force arm of the long-short-rib articulated torsional spring, and a second free end of the free ends forms the second force arm of the long-short-rib articulated torsional spring; the first force arm of the long-short-rib articulated torsional spring rotates driven by a moving of the plurality of long ribs, and the second force arm of the long-short-rib articulated torsional spring rotates driven by a moving of the plurality of short ribs; when the long-short-rib articulated torsional spring is in a natural state, an inclined angle exists between a projection of the first force arm of the long-short-rib articulated torsional spring on an axial end face of the long-short-rib articulated torsional spring and a projection of the second force arm of the long-short-rib articulated torsional spring on the axial end face of the long-short-rib articulated torsional spring.

3. The labor-saving tent frame according to claim 1, wherein the first force arm of the long-short-rib articulated torsional spring is L-shaped, the second force arm of the long-short-rib articulated torsional spring is L-shaped or I-shaped, the first force arm of the long-short-rib articulated torsional spring is located in a first plane, the second force arm of the long-short-rib articulated torsional spring is located in a second plane, and the first plane is perpendicular to the second plane.

4. The labor-saving tent frame according to claim 1, wherein each of the plurality of long ribs includes a long-rib rod and a long-rib-side articulated member sleeved on the long-rib rod, the first force arm of the long-short-rib articulated torsional spring is connected to the long-rib-side articulated member, a limiting face is provided on the long-rib-side articulated member, and the first force arm of the long-short-rib articulated torsional spring abuts against the limiting face.

5. The labor-saving tent frame according to claim 1, wherein each of the plurality of long ribs and each of the plurality of short ribs form a long-short-rib articulated pair by articulating a long-rib-side articulated member with the short-rib-side articulated member; and the long-rib-side articulated member and the short-rib-side articulated member are fixed by a long-short-rib articulated axis pin.

6. The labor-saving tent frame according to claim 1, wherein a drawstring structure is provided between the upper hub and the lower hub, the drawstring structure comprises a pair of upper string shafts and a lower string shaft, the pair of upper string shafts are provided at the upper hub horizontally and the lower string shaft is provided at the lower hub horizontally; a middle portion of the drawstring structure is fixed to the lower string shaft, body parts of the drawstring structure are located at two sides of the lower string shaft are wound around the pair of upper string shafts respectively, and two pulling ends of the drawstring structure hang down below the lower hub respectively.

7. The labor-saving tent frame according to claim 6, wherein an axial direction of the lower string shaft is parallel to an axial direction of each of the pair of the upper string shafts, a drawstring through hole horizontally runs through the lower string shaft in a radial direction, and the middle portion of the drawstring structure is provided in the drawstring through hole.

8. The labor-saving tent frame according to claim 1, wherein the upper hub is coaxial with the lower hub and provided with an upper sleeve, the lower hub is provided with a lower sleeve, and the upper sleeve and the lower sleeve are both coaxial with the upper hub and are adaptively sleeved with each other.

9. The labor-saving tent frame according to claim 8, wherein at least one of the upper sleeve and the lower sleeve is provided with a structure for forming an axial limit between the upper sleeve and the lower sleeve.

10. The labor-saving tent frame according to claim 1, wherein a drawstring structure is further provided between the upper hub and the lower hub, the drawstring structure comprises an upper-hub drawstring hole vertically passing through a lower end surface of the upper hub; a limiting mechanism is provided at the drawstring structure and has a diameter greater than the upper-hub drawstring hole; a section of the drawstring structure provided with the limiting mechanism is located above the upper-hub drawstring hole, and two pulling ends of the drawstring structure pass through the upper-hub drawstring hole and the lower hub downwards.

11. A labor-saving tent frame, comprising an upper hub and a lower hub, wherein the upper hub is articulated with inner ends of a plurality of long ribs, the lower hub is articulated with inner ends of a plurality of short ribs, and outer ends of the plurality of short ribs are articulated to the plurality of long ribs in one-to-one correspondence; the tent frame further comprises a long-short-rib articulated torsion spring, the long-short-rib articulated torsion spring is provided with a first force arm of the long-short-rib articulated torsion spring and a second force arm of the long-short-rib articulated torsion spring, and the plurality of long ribs and the plurality of short ribs are fixed to the first force arm of the long-short-rib articulated torsion spring and the second force arm of the long-short-rib articulated torsion spring respectively;

wherein each of the plurality of long ribs and each of the plurality of short ribs form a long-short-rib articulated pair by articulating a long-rib-side articulated member with a short-rib-side articulated member; and the long-rib-side articulated member and the short-rib-side articulated member are fixed by a long-short-rib articulated axis pin;

wherein the long-rib-side articulated member is provided with a long-rib through hole, and a first articulated shaft seat and a second articulated shaft seat, the first articulated shaft seat is provided with a first articulated shaft hole, the second articulated shaft seat is provided with a second articulated shaft hole, an axial direction each of the first articulated shaft hole and the second articulated shaft hole is perpendicular to an axial direction of the long-rib through hole; a first escape groove is concavely provided on the first articulated shaft seat, a second escape groove is concavely provided on the second articulated shaft seat, the first escape groove is opposite to the second escape groove, a first end of the first escape groove starts from a root of the first articulated shaft seat, and a second end of the first escape groove terminates at least at the first articulated shaft hole, a first end of the second escape groove starts from a root of the second articulated shaft seat, and a second end of the second escape groove terminates at least at the second articulated shaft hole.

12. A labor-saving tent frame, comprising an upper hub and a lower hub, wherein the upper hub is articulated with inner ends of a plurality of long ribs, the lower hub is articulated with inner ends of a plurality of short ribs, and outer ends of the plurality of short ribs are articulated to the plurality of long ribs in one-to-one correspondence; the tent frame further comprises a long-short-rib articulated torsion spring, the long-short-rib articulated torsion spring is provided with a first force arm of the long-short-rib articulated torsion spring and a second force arm of the long-short-rib articulated torsion spring, and the plurality of long ribs and the plurality of short ribs are fixed to the first force arm of the long-short-rib articulated torsion spring and the second force arm of the long-short-rib articulated torsion spring respectively;

wherein the upper hub is provided with a long-rib connecting engaged groove for connecting the plurality of long ribs, the lower hub is provided with a short-rib connecting engaged groove for connecting the plurality of short ribs, the upper hub is further provided with an upper engaged groove, the lower hub is further provided with a lower engaged groove corresponding to the upper engaged groove, a limiting hook is provided between the upper hub and the lower hub, and two ends of the limiting hook are respectively located in the upper engaged groove and the lower engaged groove.

* * * * *